US008579039B2

(12) United States Patent
Spindler et al.

(10) Patent No.: US 8,579,039 B2
(45) Date of Patent: Nov. 12, 2013

(54) BEACH MAINTENANCE AND CLEANING VEHICLE

(75) Inventors: Stefan Spindler, Neu-Ulm (DE); Bernd Junginger, Blaustein (DE)

(73) Assignee: Kaessbohrer Gelaendefahrzeug AG, Laupheim (DE)

( * ) Notice: Subject to any disclaimer, the term of this patent is extended or adjusted under 35 U.S.C. 154(b) by 381 days.

(21) Appl. No.: 12/930,901

(22) Filed: Jan. 19, 2011

(65) Prior Publication Data

US 2011/0180280 A1 Jul. 28, 2011

(30) Foreign Application Priority Data

Jan. 25, 2010 (DE) ..... 10 2010 006 278

(51) Int. Cl.
*E01H 12/00* (2006.01)

(52) U.S. Cl.
USPC ..... 171/124

(58) Field of Classification Search
USPC ..... 171/45, 46, 11, 112, 124, 125, 171/140–144, 118–120; 180/234, 235, 242; 404/122, 124, 128, 133.2
See application file for complete search history.

(56) References Cited

U.S. PATENT DOCUMENTS

| | | | | |
|---|---|---|---|---|
| 4,993,498 | A | 2/1991 | Fresnel | |
| 5,197,211 | A * | 3/1993 | Haug | 37/305 |
| 5,220,965 | A * | 6/1993 | Haug | 171/116 |
| 6,094,847 | A * | 8/2000 | Gallenberg | 37/422 |
| 6,253,691 | B1 * | 7/2001 | McQuinn | 111/118 |
| 6,805,204 | B2 | 10/2004 | Bauer et al. | |
| 2002/0170765 | A1 | 11/2002 | Bauer et al. | |

FOREIGN PATENT DOCUMENTS

| | | | |
|---|---|---|---|
| AU | 525943 | | 4/1981 |
| AU | 764050 | | 8/2002 |
| DE | 88 06 463 | U1 | 10/1989 |
| DE | 101 13 702 | A1 | 10/2002 |
| EP | 0 347 362 | A1 | 12/1989 |
| EP | 1 836 889 | A1 | 9/2007 |
| JP | 2000-87328 | A | 3/2000 |
| JP | 2000-257040 | | 9/2000 |
| WO | WO 91/10780 | | 7/1991 |

OTHER PUBLICATIONS

Office Action of German Patent Office issued in DE 10 2010 006 278 dated Aug. 26, 2010 (3 pages).

(Continued)

*Primary Examiner* — Robert Pezzuto
(74) *Attorney, Agent, or Firm* — Flynn, Thiel, Boutell & Tanis, P.C.

(57) ABSTRACT

A beach maintenance and cleaning vehicle for cleaning the beach with a vehicle frame and vehicle wheels, with a receiving container for receiving contaminants, and with a conveying and separating device for raising up the underlying surface and for separating contaminants out of this underlying surface and for conveying the contaminants into the receiving container. The conveying and separating device having a pick-up which is arranged and formed in such a way that it comes into contact with the underlying surface while the beach maintenance and cleaning vehicle is driving and raises up parts of said underlying surface, and a screen belt which is moved relative to the vehicle frame. There is provision for the conveying and separating device to have a comminutor which is arranged between the pick-up and the screen belt and is configured for breaking up sand lumps of the received underlying surface.

4 Claims, 1 Drawing Sheet

(56) References Cited

OTHER PUBLICATIONS

Office Action of German Patent Office issued in German Application No. 10 2010 006 278.2 dated Mar. 14, 2013 (5 pages).

Search Report of European Patent Office issued in European Application No. 11151141.6 with English translation of category of cited documents dated May 3, 2013 (9 pages).

* cited by examiner

BEACH MAINTENANCE AND CLEANING VEHICLE

FIELD OF THE INVENTION

The invention relates to a beach maintenance and cleaning vehicle for cleaning a beach. A beach maintenance and cleaning vehicle of the generic type has a vehicle frame and vehicle wheels. Furthermore, it has a receiving container for receiving contaminants and a conveying and separating device for raising up the underlying surface and for separating contaminants out of the raised up underlying surface and for conveying the contaminants into the receiving container.

Here, a beach maintenance and cleaning vehicle of the generic type has a pick-up which is arranged and formed in such a way that it comes into contact with the underlying surface while the beach maintenance and cleaning vehicle is driving and raises up parts of said underlying surface. Furthermore, said conveying and separating device has a screen belt which is moved relative to the frame.

BACKGROUND OF THE INVENTION

Beach maintenance and cleaning vehicles of the generic type are known from the prior art, inter alia from DE 101 13 702 A1. They serve to clean beaches, in particular to clean sand beaches. The functional principle of such beach maintenance and cleaning vehicles of the generic type provides for an upper layer of the underlying surface, for example therefore sand of a sand beach, to be raised up by the pick-up and be guided over a screen belt. Said screen belt allows clean sand and relatively small stones to fall through it, while contaminants are conveyed further by the screen belt and therefore pass into the receiving container and not back onto the beach.

The beach maintenance and cleaning vehicles of the generic type which are currently used have proven to be reliable tools for beach cleaning. However, the result of their work is not completely satisfactory if the underlying surface is damp, since this leads to relatively large sand lumps which are likewise conveyed by means of the screen belt undesirably into the receiving container. A similar situation applies if beach maintenance and cleaning vehicles of the generic type are to be operated with a comparatively great working depth. The underlying surface which is raised up here also forms sand lumps which pass undesirably via the screen belt into the receiving container. Said sand lumps reduce the receiving volume of the receiving container for actual contaminants and lead to the permanent removal of beach substrate.

Although it is known to cause the screen belt of a beach maintenance and cleaning vehicle of the generic type to vibrate by means of a oscillating device, in order to bring about more reliable separation of the contaminants from the uncontaminated sand, the results which are achieved by an oscillating device of this type are still in need of improvement. Despite the oscillating device, too much sand passes into the receiving container.

PROBLEM AND SOLUTION

It is therefore an object of the invention to improve a beach maintenance and cleaning vehicle of the generic type in such a way that, in particular in the case of damp or wet sand and at high working depths, it reliably separates the sand from contaminants and conveys the sand, after it has been raised up, back onto the beach.

According to the invention, this object is achieved by the fact that the conveying and separating device has a comminutor which is arranged between the pick-up and the screen belt and is configured for breaking up sand lumps of the received underlying surface and/or for separating sand from contaminants, the comminutor having, for this purpose, at least two profiled shafts which are driven rotationally in the same direction and have a parallel rotational axis, the shafts being arranged and driven in such a way that contaminants are conveyed along the upper side of said shafts to the screen belt.

A beach maintenance and cleaning vehicle of the generic type can be equipped with a dedicated traction drive, in order that it can be used in a self-sufficient manner. However, it can also be configured as a trailer which is attached to a traction engine, for example a tractor. The screen belt which is provided in a beach maintenance and cleaning vehicle according to the invention is a flexible, flat belt which is guided over at least two rolls which are arranged at the two opposite ends of the belt and which circulates, in order to convey the contaminants in the direction of the receiving container and in the process to separate the sand through holes which are provided in the screen belt, which sand then falls back onto the beach again directly or indirectly. In order to produce a shaking action, said rolls can be configured, for example, as eccentric rolls. In the simplest case, the pick-up of a beach maintenance and cleaning vehicle according to the invention is configured as an angled lifting surface which penetrates into the underlying surface of the beach. In addition, the pick-up can have a driven conveying means, for example in the form of a conveying wheel or a conveying shaft with spring steel prongs.

The special feature according to the invention lies in the fact that the comminutor which is configured for breaking up sand lumps of the received underlying surface is arranged between the pick-up and the screen belt. Said comminutor is itself driven and exerts mechanical forces on the underlying surface which has been raised up by the pick-up, which mechanical forces are sufficiently high to also break up sand lumps of a wet or damp sand. The comminutor can be configured in such a way that on its own it already makes it possible to separate the cleaned sand back onto the beach and therefore in addition also fulfills a screening function. However, it can also be configured in such a way that the underlying surface which is prepared by the comminutor if fed in its entirety to the screen belt, and in such a way that separation of the cleaned underlying surface from the contaminants does not take place until on the screen belt. The vehicle is preferably open on its underside both in the region of the comminutor and in the region of the screen belt, with the result that the cleaned underlying surface can fall directly onto the beach again.

According to the invention, the mechanical loading of the underlying surface takes place via a comminutor having at least two rotationally driven and profiled shafts with rotational axes which are parallel to one another. Said shafts exert a mechanical force loading of the underlying surface which is prepared by them, simultaneously or preferably one after another.

Here, a profiled shaft is considered to be a shaft with a shaft shape which deviates from the cylindrical shape. A profiled shaft of this type preferably has diameters which vary in the axial direction and/or a varying shape over the circumference, in particular with star-like projections. The shafts can be configured in one piece or consist of a plurality of separate components, in particular a basic shaft with star wheels pushed onto it. Here, the star wheels can preferably be produced from plastic, in particular from polyurethane or polyamide, or from steel, in particular cast steel or abrasion steel. It is particularly advantageous if the particularly loaded first shaft which faces the pick-up and has star wheels is formed from metal, in particular steel, while at least one following shaft which is loaded to a lesser extent during operation is produced from plastic.

The two shafts are two profiled shafts which are driven in the same direction, the shafts being arranged and driven in such a way that contaminants are conveyed along the upper side of said shafts to the screen belt. As a result of this design, the mechanical force loading of the underlying surface to be cleaned is brought about, in particular, by the different shafts causing mechanical jolts one after another on the underlying surface which has previously been raised up by the pick-up and is to be cleaned, and cause comminution as a result. Four or more shafts which are arranged one behind the other are preferably used.

It is particularly preferred if the profiled shafts have radially extended projections, the projections of adjacent shafts being arranged offset with respect to one another in the axial direction of the shafts and being arranged so as to overlap in a conveying direction which is orthogonal with respect to the axial direction. An arrangement of this type which can already be found in the prior art in what are known as star-type screens makes particularly advantageous mechanical loading of the conveyed underlying surface possible while ensuring at the same time that no large contaminants at all can pass between the shafts onto the underlying surface again.

A plurality of projections which lead to an approximately star-shaped cross section of the shaft in the region of the projections are preferably provided distributed over the circumference. In the axial direction of the shaft, regions with projections of this type alternate with thinned shaft regions which form recesses, into which the star-shaped projections of adjacent shafts can engage.

In order for it to be possible to react to different underlying surface conditions in a particularly satisfactory manner, there is preferably provision for it to be possible for the shafts to be set with regard to the spacing of their rotational axes. This allows the same comminutor to be capable of being used in different configurations both for a pure sandy beach with very fine grains and also for beaches, where there are also relatively small stones in the sand which should not pass into the receiving container of the beach maintenance and cleaning vehicle. Here, different configurations can be composed, for example, in such a way that, in a first configuration, only fine grain sand passes back onto the beach while, in other configurations, stones having a diameter from a few millimeters to, for example, 20 mm can also pass through the shafts onto the beach.

For this purpose, furthermore, there can also be provision for it to be possible to set the rotational speed of the shafts flexibly, for example between 150 rpm and 500 rpm.

BRIEF DESCRIPTION OF THE DRAWINGS

Besides from the claims, further aspects of the invention also result from the following description of one preferred exemplary embodiment of the invention which will be explained using the figures, in which:

DESCRIPTION OF ONE EXEMPLARY EMBODIMENT

Figures 1, 2:
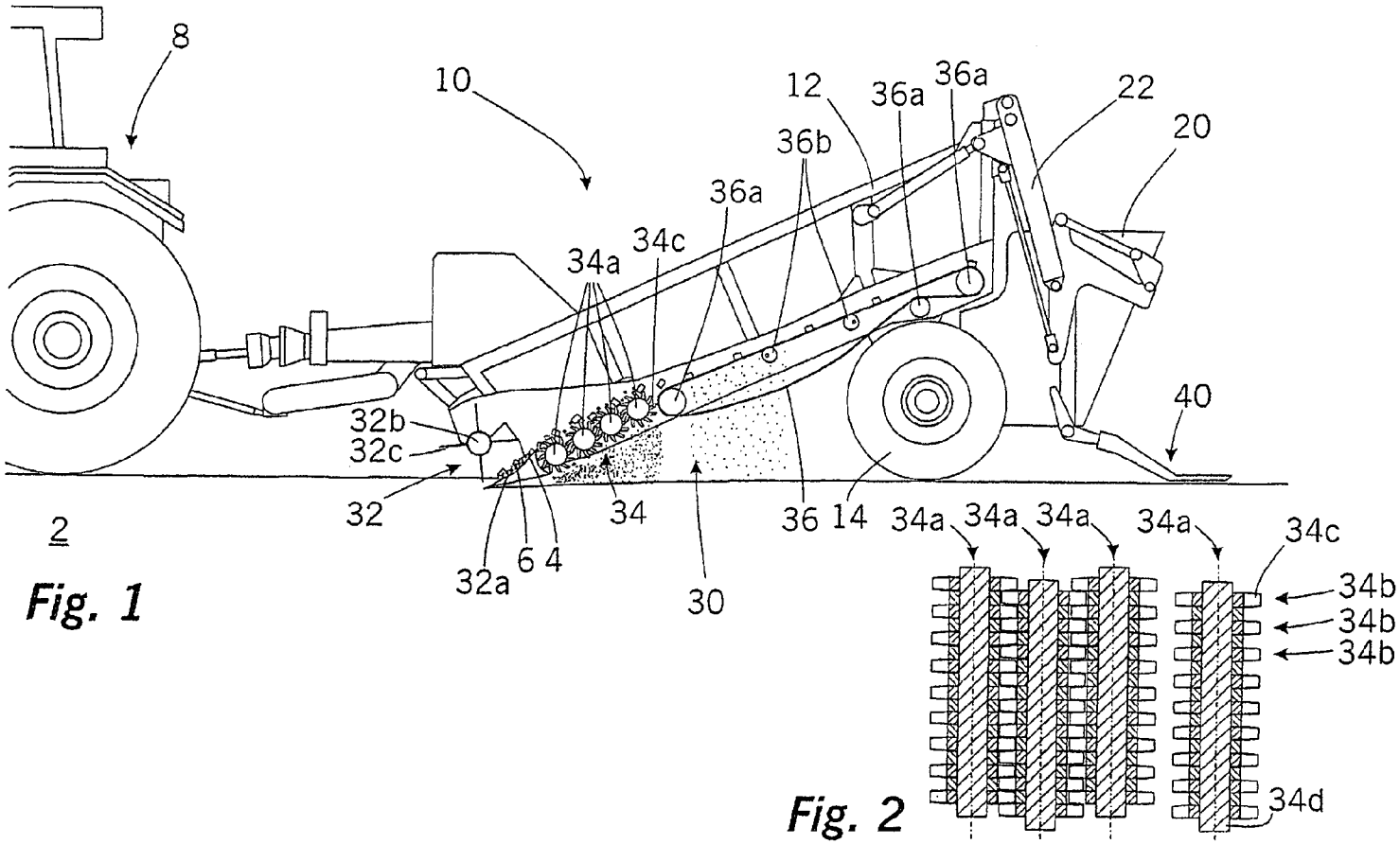
FIG. 1 shows a beach maintenance and cleaning vehicle according to the invention in a partially sectioned side view.
FIG. 2 shows part of a conveying and separating device of the beach maintenance and cleaning vehicle of FIG. 1 in a diagrammatic illustration.

The beach maintenance and cleaning vehicle 10 shown in FIG. 1 is a beach maintenance and cleaning vehicle which is configured as a trailer and is pulled by a traction engine which is separate from it, in the present case a tractor 8.

The beach maintenance and cleaning vehicle 10 has a main frame 12, at the rear end of which wheels 14 of the beach maintenance and cleaning vehicle 10 are provided. A receiving container 20 is provided on the rear side behind the frame 12, which receiving container 20 can be raised and pivoted by means of a hydraulic movement apparatus 22 for the purpose of emptying. A comminuting, conveying and separating device 30 of the beach maintenance and cleaning vehicle 10 extends along the frame 12 from the front to the rear. Said comminuting, conveying and separating device 30 serves to receive contaminated sand from an underlying surface 2, to separate the sand from contaminants and to transport the contaminants into the receiving container 20.

The front end of the comminuting, conveying and separating device 30 is formed by the pick-up 32. The latter comprises an obliquely positioned conveying surface 32*a* which penetrates into the underlying surface in the manner shown and in the process raises up an upper layer of the underlying surface. The conveying surface can preferably be set with regard to its penetration depth into the underlying surface. The design of the beach maintenance and cleaning vehicle 10 according to the invention is also suitable, in particular, for comparatively large penetration depths. The raising up of the underlying surface is assisted by a driven conveying wheel 32*b* with spring steel prongs 32*c*. The underlying surface which is conveyed by the pick-up 32 into the beach maintenance and cleaning vehicle 10 comprises sand lumps 4 indicated by dotted lines in FIG. 1 and diverse contaminants which are represented in the figure by rectangles 6. Here, in particular in the case of a wet or damp underlying surface and/or in the case of a great penetration depth of the conveying surface 32*a* into the underlying surface, the sand is composed to a considerable extent of the sand lumps 4 which are not free flowing to begin with.

In order to break up said sand lumps 4 and to fulfill a coarse screening function, the pick-up 32 is adjoined by a comminutor 34 which is also shown again in FIG. 2. Said comminutor 34 comprises four comminutor and screening shafts 34*a* which are arranged such that they can be rotated parallel to one another and rotate in the clockwise direction in the same direction in relation to FIG. 1, a drive assembly (not shown), for example a hydraulic motor, being provided for driving said comminutor shafts 34*a*. The comminutor and screening shafts 34*a* together form what is known as a star-type screen. To this end, they in each case have a multiplicity of star crowns 34*b* which are made from metal or plastic, are pushed onto a basic shaft 34*d*, are spaced apart from one another axially and have projections 34*c* which extend to the outside. As can be seen, in particular, from FIG. 2, in which the last shaft 34*a* is displaced to the right with respect to its installed position for improved clarity, the star crowns 34*b* of adjacent shafts 34*a* are offset with respect to one another in such a way that the shafts 34*a* can be arranged such that they overlap one another. The spacing of the comminutor and screening shafts 34*a* is not fixed, but rather can be changed by means of a setting mechanism (not shown in greater detail), in order to react to specific underlying surface conditions. The star crowns 34*b* of the first shaft 34*a* on the left in FIG. 1 are preferably formed from metal, while the star crowns 34*b* of the following shafts 34*a* are formed at least partly from plastic.

The raised up underlying surface which has been conveyed via the pick-up 32 to the comminutor 34 and substantially comprises sand lumps 4 and contaminants 6 is conveyed further to the right in relation to FIG. 1 by the comminutor and screening shafts 34*a* which rotate in the same direction. The star-like projections 34*c* on the shafts 34*a* result in a wide variety of mechanical loadings which lead to breaking up of the sand lumps 4. The contaminants 6, for example drinks cans, cigarette butts, algae and the like, are scarcely influenced by the comminutor and screening shafts 34*a*.

In particular, on account of the overlapping design of the comminutor and screening shafts 34*a*, the contaminants 6 cannot pass between the shafts 34*a* back onto the underlying surface of the beach. Depending on the spacing of the shafts 34*a* which has been set, this is possible only for the previous sand lumps 4 which have been comminuted into individual sand grains or smaller lumps and have enough space between adjacent projections 34*c* of the same star wheel 34*b*.

The contaminants with sand still adhering to them and sand lumps which have already been precomminuted by the comminutor 34 pass on the other side of the right hand one of the four comminutor and screening shafts 34*a* onto a screen belt 36 which circulates in the clockwise direction guided by guide rolls 36*a* and in the process is set in vibration by eccentric rolls 36*b*.

In the manner which is already known from the prior art, the sand is separated from the contaminants on this screen belt and relatively small sand lumps are broken up further by the vibrations of the belt 36. In a manner which is not shown, the belt 36 has apertures, through which that sand which has not already been conveyed back onto the beach by the comminutor 34 passes onto the ground below the vehicle. In the course of the locomotion of the beach maintenance and cleaning vehicle 10, the sand which has been cleaned in this way is pressed down by a smoothing means 40 to form a homogeneous and esthetically advantageous sand surface. The contaminants 6 remain in the receiving container 20 and are later disposed of. The design with the comminutor 34 and the screen belt 36 arranged behind it results in scarcely any sand being received in the receiving container 20.

The invention claimed is:

1. A beach maintenance and cleaning vehicle for cleaning the beach comprising:

a vehicle frame and vehicle wheels;

a receiving container for receiving contaminants; and a conveying and separating device for raising up the underlying surface and for separating contaminants out of the underlying surface and for conveying the contaminants into the receiving container;

the conveying and separating device having a pick-up which is arranged and formed in such a way that the pick-up comes into contact with the underlying surface while the beach maintenance and cleaning vehicle is driving and raises up parts of said underlying surface, and a screen belt which is moved relative to the vehicle frame;

wherein the conveying and separating device has a comminutor arranged between the pick-up and the screen belt and configured for breaking up sand lumps of the received underlying surface and/or for separating sand from contaminants, the comminutor having, for this purpose, at least two profiled shafts which are driven rotationally in the same direction and have a parallel rotational axis, the profiled shafts being arranged and driven in such a way that contaminants are conveyed along an upper side of said profiled shafts to the screen belt.

2. The beach maintenance and cleaning vehicle according to claim 1, wherein the profiled shafts have radially extended projections, the projections of adjacent profiled shafts being arranged offset with respect to one another in an axial direction of the profiled shafts and being arranged so as to overlap in a conveying direction which is orthogonal with respect to the axial direction.

3. The beach maintenance and cleaning vehicle according to claim 2, wherein the projections of at least one of the profiled shafts faces the pick-up and is formed from metal, and the projections of at least one of the profiled shafts following the at least one of the profiled shafts facing the pick-up is formed from plastic.

4. The beach maintenance and cleaning vehicle according to claim 1, wherein the profiled shafts can be set with regard to a spacing of their rotational axes.

* * * * *